US012440723B2

(12) United States Patent
Munro et al.

(10) Patent No.: US 12,440,723 B2
(45) **Date of Patent: *Oct. 14, 2025**

(54) MECHANICAL ASSEMBLIES FOR A TREADMILL

(71) Applicant: Peloton Interactive, Inc., New York, NY (US)

(72) Inventors: Daniel Leon Matalon Munro, Snohomish, WA (US); Azhar Meyer, New York, NY (US); Andrea Fox, Woodinville, WA (US); Joel Friedrick, San Diego, CA (US); Matthew Baker, New York, NY (US); David Hermiller, New York, NY (US)

(73) Assignee: Peloton Interactive, Inc., New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/668,626

(22) Filed: May 20, 2024

(65) Prior Publication Data

US 2024/0299801 A1 Sep. 12, 2024

Related U.S. Application Data

(63) Continuation of application No. 18/501,516, filed on Nov. 3, 2023, now Pat. No. 11,986,697.

(Continued)

(51) Int. Cl.
*A63B 22/02* (2006.01)
*A63B 71/00* (2006.01)

(52) U.S. Cl.
CPC ..... *A63B 22/02* (2013.01); *A63B 71/0054* (2013.01); *A63B 2071/009* (2013.01); *A63B 2209/08* (2013.01)

(58) Field of Classification Search
CPC . A63B 22/02; A63B 24/0087; A63B 71/0054; A63B 2071/0081;

(Continued)

(56) References Cited

U.S. PATENT DOCUMENTS 4,708,337 A * 11/1987 Shyu ..... A63B 22/025 482/901
5,085,426 A * 2/1992 Wanzer ..... A63B 22/02 482/54

(Continued)

FOREIGN PATENT DOCUMENTS

AU 2018203704 A1 11/2018
CN 207323943 U 5/2018

(Continued)

OTHER PUBLICATIONS

International Search Report and Written Opinion dated Feb. 29, 2024 for International Application No. PCT/US2023/078494.

*Primary Examiner* — Gary D Urbiel Goldner
(74) *Attorney, Agent, or Firm* — AMPACC Law Group, PLLC

(57) ABSTRACT

Various devices, systems, methods, and apparatuses utilize mechanical assemblies to prevent, detect, and/or mitigate objects from entering or moving close to or under a treadmill or exercise machine. In some embodiments, a guard, or guard assembly, is attached or otherwise fixed to a rear area of a treadmill. The guard assembly may include an end cap and pivoting guard configured to be retrofit to existing treadmills, such as to a rear end or area of a deck or frame of a treadmill.

18 Claims, 12 Drawing Sheets

Related U.S. Application Data

(60) Provisional application No. 63/502,301, filed on May 15, 2023, provisional application No. 63/382,469, filed on Nov. 4, 2022.

(58) Field of Classification Search
CPC ..... A63B 2071/009; A63B 2209/08; A63B 2220/80; A63B 2220/801; A63B 2220/83; A63B 2220/833; A63B 2225/09
See application file for complete search history.

(56) References Cited

U.S. PATENT DOCUMENTS

| | | | | | |
|---|---|---|---|---|---|
| 5,088,729 | A * | 2/1992 | Dalebout | A63B 22/025 | 482/54 |
| 5,163,885 | A * | 11/1992 | Wanzer | A63B 22/02 | 482/54 |
| 5,820,525 | A * | 10/1998 | Riley | A63B 22/02 | 482/901 |
| 5,897,461 | A * | 4/1999 | Socwell | A63B 22/02 | 482/54 |
| 6,033,347 | A * | 3/2000 | Dalebout | A63B 22/02 | 482/54 |
| 6,390,955 | B1 * | 5/2002 | Wang | A63B 22/02 | 482/54 |
| 6,860,839 | B1 | 3/2005 | Dice et al. | | |
| 10,960,289 | B1 | 3/2021 | Colcord | | |
| 11,577,121 | B2 * | 2/2023 | Hsu | A63B 22/0235 | |
| 11,986,697 | B1 * | 5/2024 | Munro | A63B 24/0087 | |
| 2004/0106503 | A1 * | 6/2004 | Wu | A63B 22/0257 | 482/54 |
| 2006/0252605 | A1 * | 11/2006 | Wang | A63B 22/0023 | 482/54 |
| 2006/0276306 | A1 | 12/2006 | Pan et al. | | |
| 2016/0213976 | A1 * | 7/2016 | So | A63B 71/0622 | |
| 2022/0355179 | A1 * | 11/2022 | Nguyen | G01S 13/88 | |
| 2022/0362627 | A1 * | 11/2022 | Li | A63B 22/0235 | |
| 2022/0362652 | A1 | 11/2022 | Del Monaco et al. | | |
| 2023/0072180 | A1 | 3/2023 | Baker et al. | | |
| 2023/0390601 | A1 * | 12/2023 | Baker | A63B 22/0235 | |
| 2024/0149105 | A1 * | 5/2024 | Munro | A63B 22/02 | |

FOREIGN PATENT DOCUMENTS

| | | | |
|---|---|---|---|
| CN | 208260085 | U | 12/2018 |
| CN | 212038783 | U | 12/2020 |
| CN | 216022943 | U | 3/2022 |

* cited by examiner

MECHANICAL ASSEMBLIES FOR A TREADMILL

CROSS-REFERENCE TO RELATED APPLICATIONS

This application is a continuation of U.S. patent application Ser. No. 18/501,516 filed on Nov. 3, 2023, now U.S. Pat. No. 11,986,697 issued May 21, 2024, which claims priority to U.S. Provisional Patent Application No. 63/382,469, filed on Nov. 4, 2022, entitled MECHANICAL ASSEMBLIES FOR A TREADMILL, and U.S. Provisional Patent Application No. 63/502,301, filed on May 15, 2023, entitled MECHANICAL ASSEMBLIES FOR A TREADMILL, which are hereby incorporated by reference in their entirety.

BACKGROUND

A treadmill or other exercise machine may have a moving surface controlled by a motor. The moving surface can move over a deck or other supporting assembly, and can be a belt-based surface, a slat-based surface, or other type of surface that moves around the deck, enabling a user (e.g., a runner) to walk, jog, and/or run at different speeds or inclines.

Typically, a treadmill may have various safety mechanisms, such as a key or other component that causes a treadmill to stop operation during an unsafe or unintended operation (e.g., when a user steps off a moving surface). However, there can be drawbacks associated with typical safety mechanisms, as they may be focused on a user running/walking on the treadmill, among other things.

BRIEF DESCRIPTION OF THE DRAWINGS

Embodiments of the present technology will be described and explained through the use of the accompanying drawings.

Figure 1A:
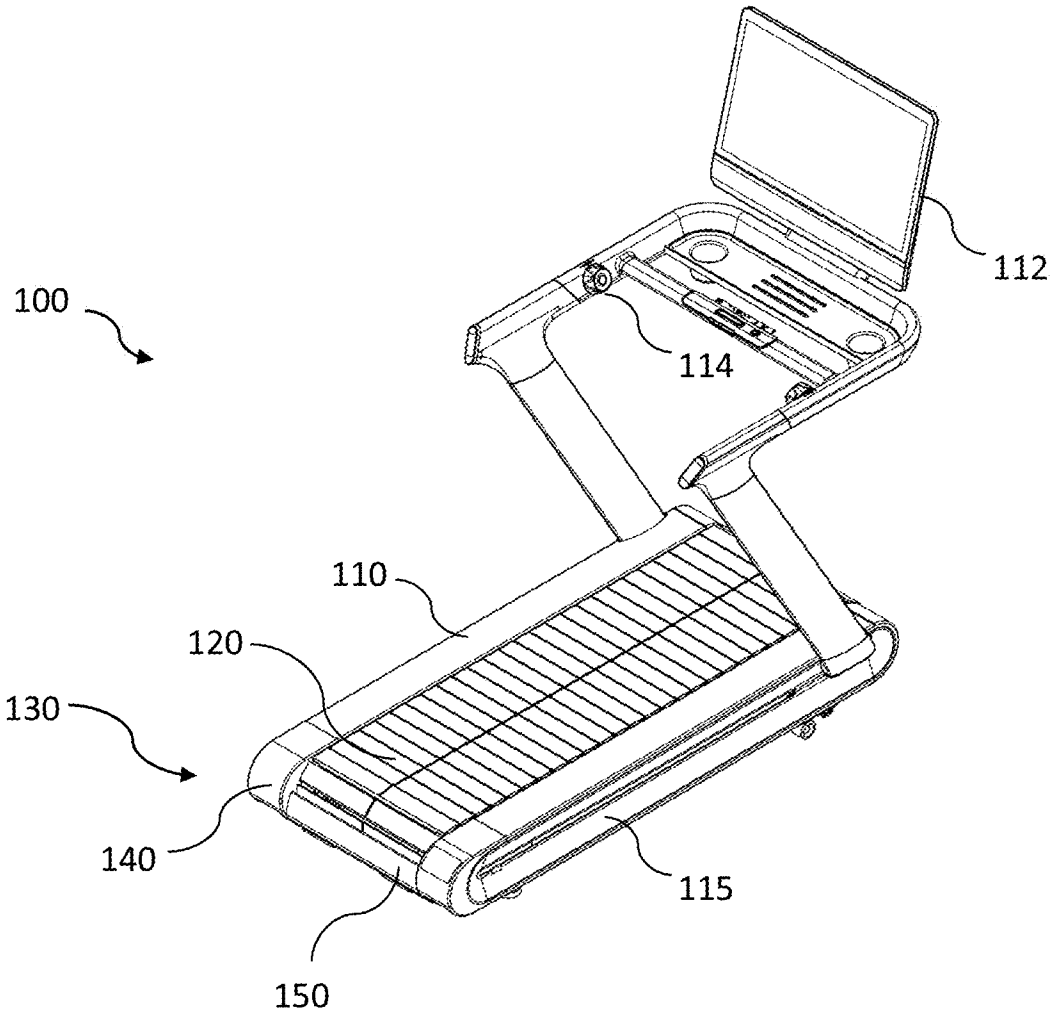
FIGS. 1A-1B are diagrams illustrating a treadmill having a guard assembly.

In the drawings, some components are not drawn to scale, and some components and/or operations can be separated into different blocks or combined into a single block for discussion of some of the implementations of the present technology. Moreover, while the technology is amenable to various modifications and alternative forms, specific implementations have been shown by way of example in the drawings and are described in detail below. The intention, however, is not to limit the technology to the particular implementations described. On the contrary, the technology is intended to cover all modifications, equivalents, and alternatives falling within the scope of the technology as defined by the appended claims.

DETAILED DESCRIPTION

Overview

Various devices, systems, methods, and apparatuses utilize mechanical assemblies to prevent, detect, and/or mitigate objects from entering or moving close to or under a treadmill or exercise machine. In some embodiments, a guard, or guard assembly, is attached or otherwise fixed to a rear area of a treadmill (e.g., in place of an end cap). For example, the guard assembly may include an end cap and pivoting guard configured to be retrofit to existing treadmills, such as to a rear end or area of a deck or frame of a treadmill.

The guard assembly protects or otherwise prevents objects, such as solid or deformable objects, from moving under the treadmill or being pulled under the treadmill by a moving belt or slat-based surface. In some cases, the guard assembly includes a switch or signaling mechanism (e.g., a trigger) that, when the assembly breaks or pivots away from the treadmill, causes the treadmill to adjust its current operation (e.g., slow or stop a moving belt or slat-based surface).

In some embodiments, the treadmill can include an infrared beam (IR) trigger mechanism that is positioned under the deck of the treadmill (e.g., near the rear). The IR mechanism can detect an object impinging on an IR beam (or multiple IR beams), and modify current operations, such as slowing down, shutting off, or otherwise adjusting to a different state of operation.

In some embodiments, the treadmill can include other mechanical or sensor-based detection mechanisms or components. For example, the treadmill can include one or more inclinometers, accelerometers, gyroscopes, or other sensors that can detect that a rear of a treadmill is moving upwards, tilting at an angle, or otherwise abnormally, and cause the treadmill to modify current operations, such as slowing down, shutting off, or otherwise adjusting to a different state of operation.

Thus, in various embodiments, a guard assembly may be a stand-alone assembly via which a pivoting guard can be positioned at a rear end of a treadmill and the position of the guard can be monitored during operation. In some cases, the guard assembly, therefore, may only utilize its own components to position the guard, to attach the guard, and/or determine when the guard moves an open and closed position, among other benefits.

Various embodiments of the apparatuses, devices, systems, and methods will now be described. The following description provides specific details for a thorough understanding and an enabling description of these embodiments. One skilled in the art will understand, however, that these embodiments may be practiced without many of these details. Additionally, some well-known structures or functions may not be shown or described in detail, so as to avoid unnecessarily obscuring the relevant description of the various embodiments. The terminology used in the description presented below is intended to be interpreted in its broadest reasonable manner, even though it is being used in conjunction with a detailed description of certain specific embodiments.

Examples of the Guard Assembly

The technology described herein is directed, in some embodiments, to various mechanical or sensor-based technologies that can prevent objects from entering an area under a treadmill deck or otherwise modify operations of the treadmill upon detecting or determining an object has entered, or is being prevented from entering, the area under the treadmill.

As described herein, in some embodiments, a rear guard, or guard assembly, is attached or otherwise fixed to a rear area of a treadmill, such as via an end cap (or in place of an end cap) of the treadmill. The guard assembly protects or otherwise prevents objects, such as solid or deformable objects, from being pulled under the treadmill by a moving belt or slat-based surface.

In some cases, the guard assembly can break or pivot away in response to certain force vectors being applied to the assembly. For example, the rear guard can include a pivoting guard that is removably or releasably attached to a rear of a treadmill via magnets (e.g., magnets within an end cap on one or both sides), allowing the guard to break away or otherwise pivot away from the end cap of the assembly in response to forces applied at certain magnitudes and/or directions.

In some cases, the guard assembly is fixed with a minimal gap or spacing between the outer guard and the rear of the treadmill (e.g., a gap formed between a moving belt or surface and the outer guard). In some cases, the guard assembly covers or guards a lower portion of the treadmill. For example, the guard can be positioned or located on a lower half of end of the treadmill or at positions along a curve of the end of the treadmill (e.g., between 70-100 degrees from vertical), and prevent objects from contacting a moving belt or slat-based surface (slatted surface) as the surface moves down and under the deck of the treadmill.

Thus, the guard is positioned to protect and/or cover a lower portion of the moving surface as it moves around the rear of the treadmill and under the treadmill, such as the portion of the moving surface that curves around the deck of the treadmill.

Figure 1B:
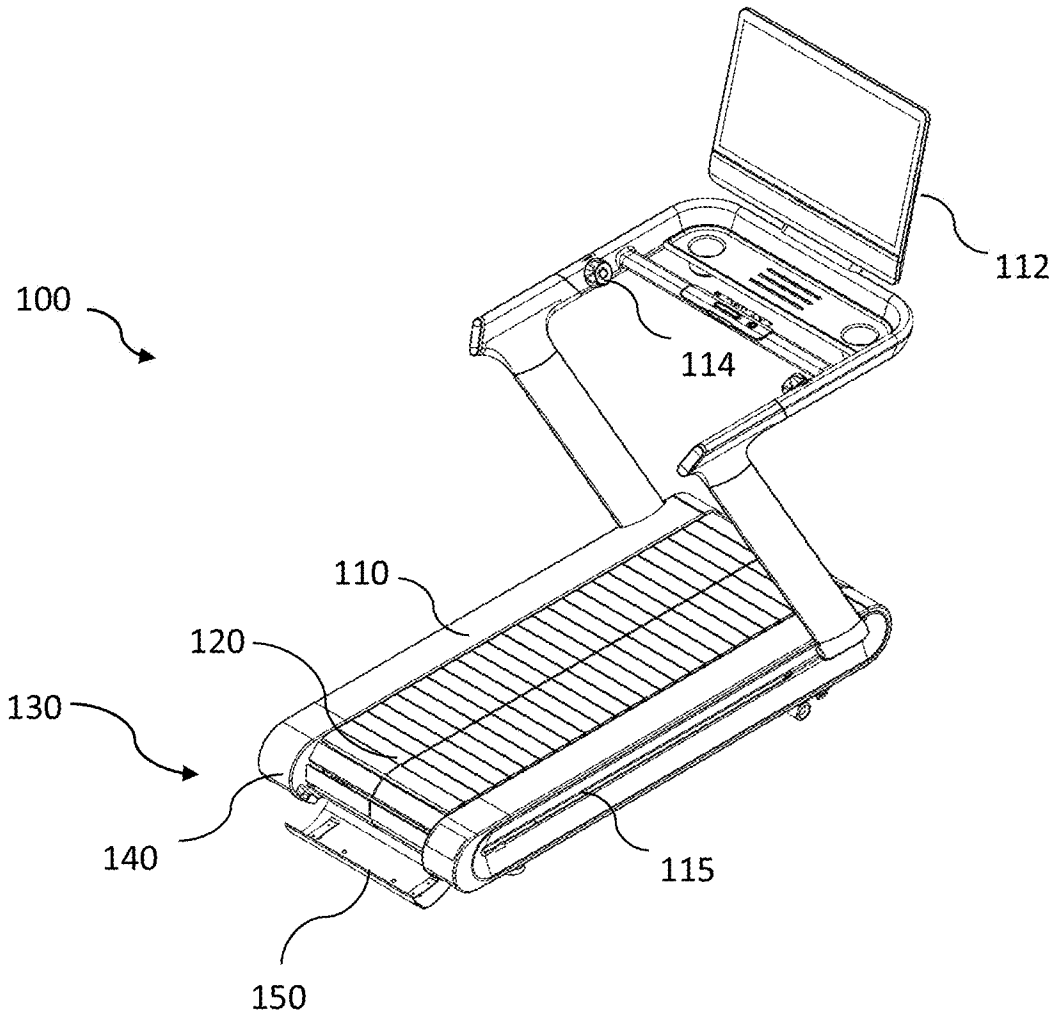

FIGS. 1A-1B are diagrams illustrating a treadmill 100 with a guard assembly. The treadmill 100 includes a deck 110 or frame, which can include side walls 115 that extend from a front area of the treadmill to a rear area of the treadmill. A moving surface 120, such as a slat-based belt or other belt structure, moves around the deck 110 during operation of the treadmill, providing a moving running or walking surface for a user of the treadmill 100. The treadmill may also include a display 112 that presents content to a user, such as exercise classes, interactive games, user metrics, entertainment, alerts, and so on, and/or one or more controls 114, such as rotary controls, user interface elements, navigation buttons (e.g., on/off buttons, belt speed controls), and so on.

The treadmill 100 includes a guard assembly 130. The guard assembly 130 is configured to be fixed or attached to a rear area of the deck 110. For example, the guard assembly 130 may be fixed to, but separate from, the side walls 115 of the deck 110. Thus, the guard assembly 130, in various embodiments, can be retrofit to different treadmills, as it can function without any use of components that are part of the deck 110 or frame of the treadmill 100. For example, the guard assembly 130 can replace one or more end caps or end components of a treadmill when installed or retrofit to the treadmill.

The guard assembly 130 includes an end cap 140 and a guard 150, which can be in a closed position (see FIG. 1A) when the treadmill is in use, and an open position (see FIG. 1B), which prevents use of the treadmill. As described herein, the end cap 140 is configured to be fixed to a rear end or area of the deck 110 of the treadmill 100, such that the belt 120 can move around the deck 110 to an underside of the treadmill 100 without obstruction. The guard 150, as depicted, is positioned to cover a lower area of the rear end of the deck 110, such as an area of the deck 110 where the belt 120 descends under the deck 110 of the treadmill 100.

The guard 150 may be formed of a rigid material, such as steel or another metal, and may include one or more rigid structural components, such as one or more horizontal ribs or braces that provide structural support or otherwise stiffen the guard 150, such that the guard 150 does not flex during movement or when impinged or struck by an object. The guard 150, in some cases, may be a composite of metal and plastic, or may include magnetic components that facilitate magnetic coupling with an end cap when the guard is positioned in a closed position.

Figure 2:
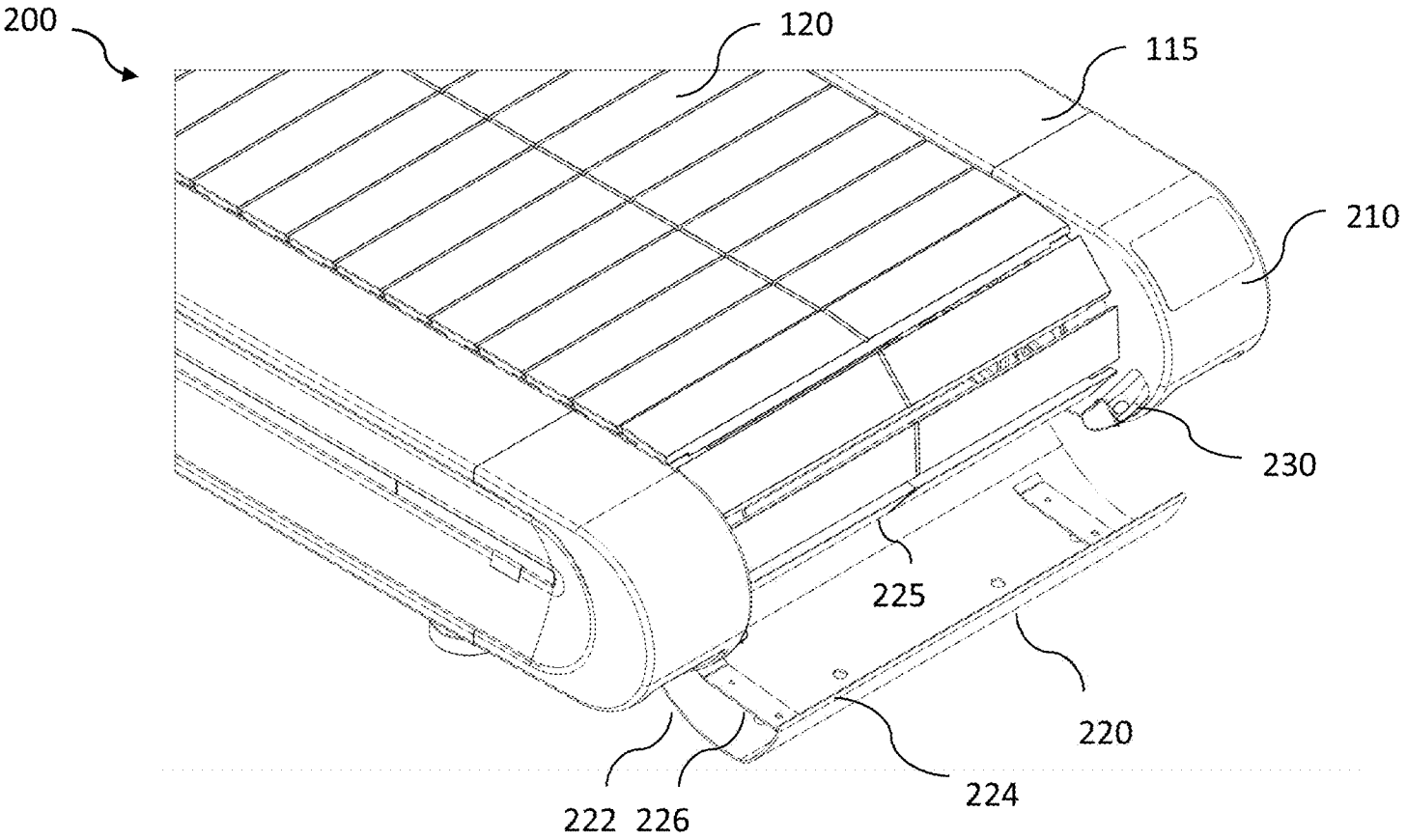
FIG. 2 is a diagram illustrating example components of a guard assembly for a treadmill.

FIG. 2 is a diagram 200 illustrating an example of a treadmill 100 having a guard assembly with a pivoting, breakaway guard. The guard assembly includes an end cap 210 and a guard 220 releasably and/or pivotably attached to the end cap 210. The end cap 210 includes a coupling mechanism 230 (on both sides of the end cap 210), which fixes, attaches, or couples the guard 220 (e.g., a top portion) to the end cap 210.

The coupling mechanism 230 is positioned or disposed within an inner area of the end cap 210, such as on an inner surface of the end cap 210. As described herein, the coupling mechanism may be attached (e.g., bolted) to the inner surface of the end cap 210 or integrated into (partially contained) the end cap 210.

The guard 220 is fixed to the end cap 210 via a pivot component 225, such as at a lower portion of the guard 220. When in a closed position (not shown), the guard 220 is held or positioned proximate to the rear of the deck 110 via the coupling mechanism 230. For example, a top portion 224 is positioned proximate to the coupling mechanism 230 and held in place via a magnet or magnets of the coupling mechanism 230, and a body 222 of the guard 220 covers and/or protects a lower section of the deck 110, such as an area where the belt 120 moves down and into an underneath area of the deck 110. The body 222 may include a brace 226 or strap that provides support for the body 222 of the guard 220.

The coupling mechanism 230 also includes an Electro-Mechanical switch that is coupled to an electrical system of the treadmill 200. The switch 240 is positioned proximate to the magnet, and functions to send a signal that indicates whether the guard 220 is in a closed position (e.g., coupled to the magnet 230) and/or an open position (as shown in FIG. 2), where the guard 220 is not coupled to the magnet 230 and has pivoted away from the end cap 210.

The coupling mechanism 230, in some cases, can include a shape or housing that supports the attachment of the top portion of the guard 220 to the end cap 210, one or more magnets that releasably fix or attach the guard 220 to the end cap 210, and a switch or other component that sends a signal to the treadmill 200 regarding a status of the guard 220 (e.g., the guard 220 is open, closed, or moving).

Figure 3A:
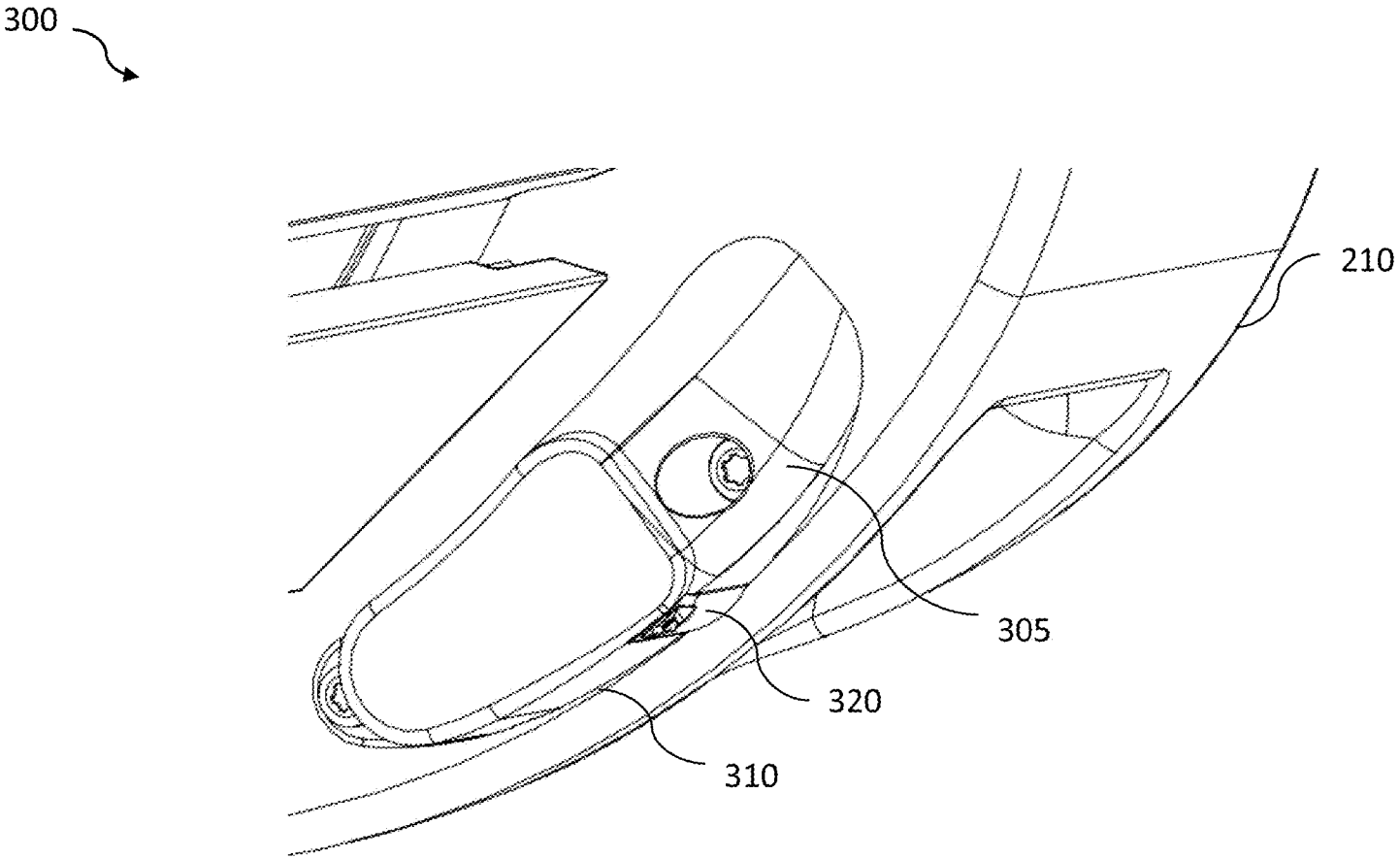
FIGS. 3A-3C are diagrams illustrating example components of a coupling mechanism for a guard assembly.
Figure 3B:
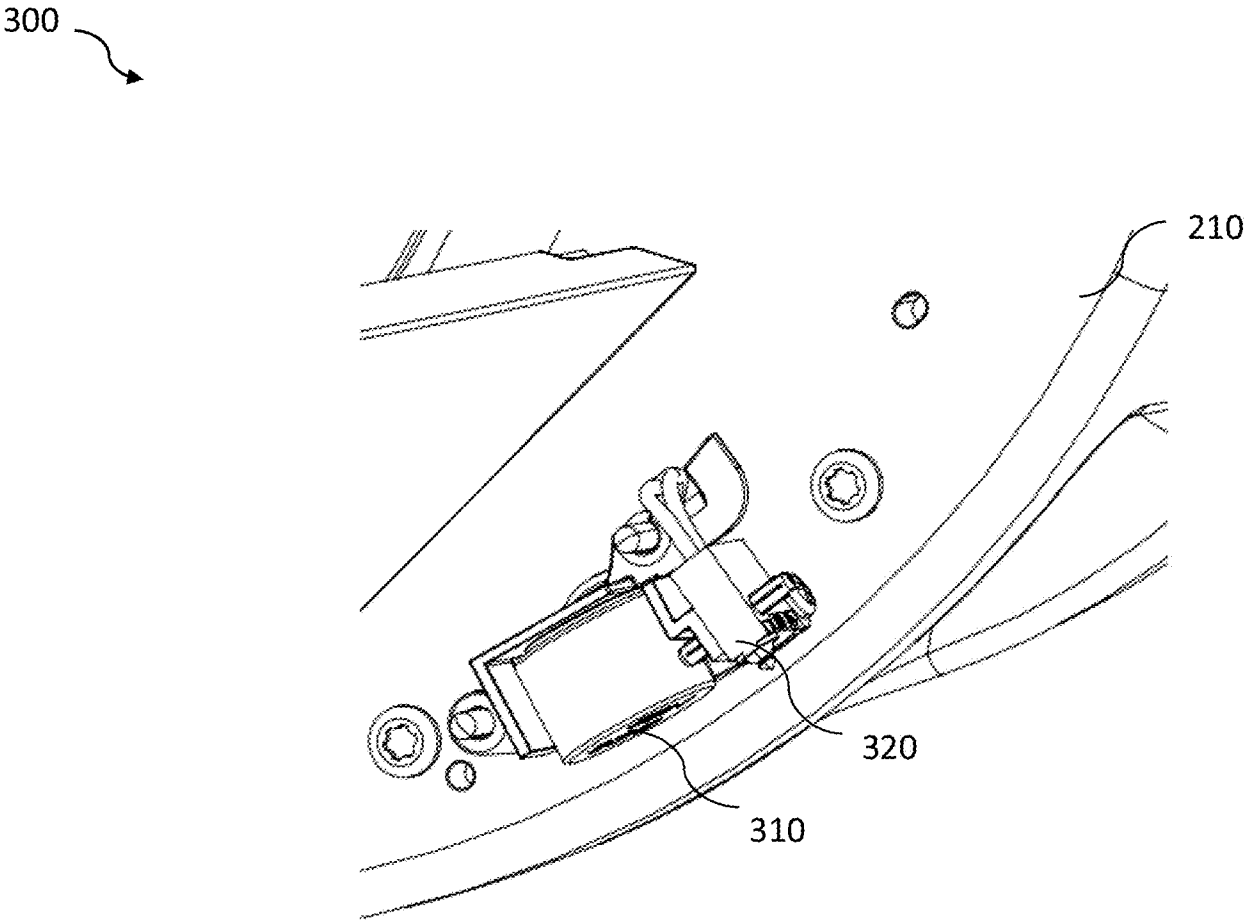

FIGS. 3A-3B illustrate an example coupling mechanism 300. As shown, the coupling mechanism 300 includes a cover 305 or housing (shown in FIG. 3A) that contains a magnet 310 and a switch 320 (shown in FIG. 3B with the cover 305 removed), where the magnet 310 is positioned below the switch. The switch 320 operates to send information regarding whether the guard 220 is coupled to the magnet 310. Thus, the magnet 310 fixes and/or positions the guard in place (e.g., is positioned to support the weight of a guard, such as at a body or center section of the guard), and the switch 320 operates to transmit signals that indicate whether the guard is in the open position or the closed position.

In some cases, the coupling mechanism 300 may include multiple magnets, such as two magnets. For example, the coupling mechanism 300 may include a number of magnets that facilitate removably fixing a guard in the closed position, where the number is based on the size of the magnets, the power of the magnets, and/or the weight of the guard.

Figure 3C:
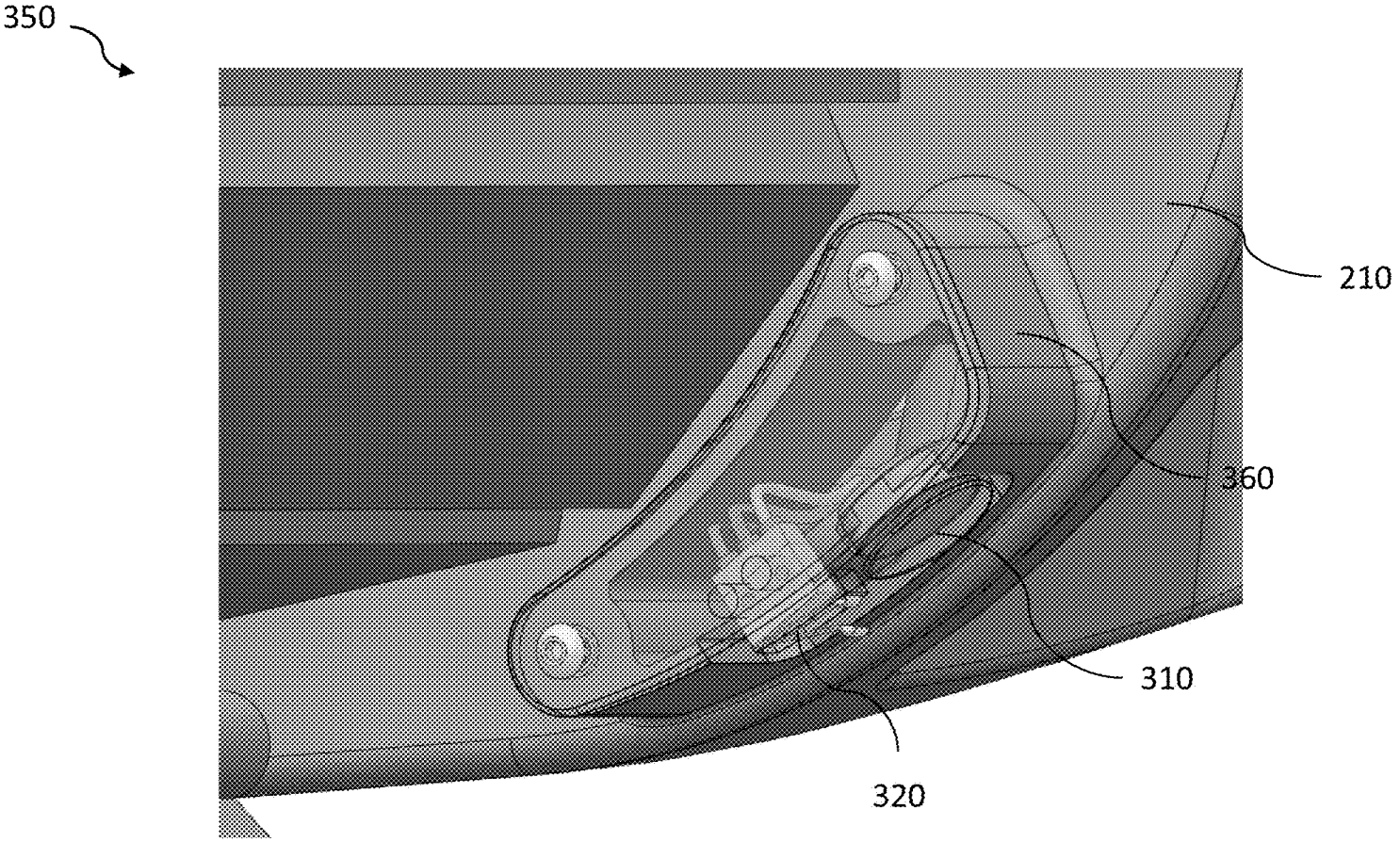

While FIGS. 3A-3B depict a coupling mechanism 300 where the magnet 310 is positioned below the switch 320, other configurations are possible. FIG. 3C illustrates another example coupling mechanism 350. As shown, the coupling mechanism 350 includes a receiving shelf 360 that receives a top portion of a guard, such as a hook-shaped portion that can fit or be placed onto the shelf 360. The coupling mechanism 350 also includes the magnet 310 and the switch 320, where the magnet 310 is positioned above the switch 320.

Referring back to FIG. 2, in some embodiments, the rear guard 220 is mounted to the pivot component 225, or a similar pivot point, under or beneath a rear roller of the treadmill 200. The pivot component 225, which may be part of the end cap 210, can also facilitate the breaking away of the guard 220, as described herein. For example, the guard 220 can pivot away from the treadmill 200 when an object enters an opening between the guard 220 and the treadmill (e.g., the belt 120 or roller).

The action of pivoting of the guard 220, or breaking away from the coupling mechanism 230, can modify operations of the treadmill 200 (e.g., stopping or slowing of the belt or moving surface), such as via a cut to the power of the treadmill 200 via the switch 320. For example, when the guard 220 pivots away from the belt 120 more than a certain distance (e.g., 5 mm or greater) or partially detaches from the magnet 310 and/or the coupling mechanism 230 or 300, the switch 320, or switches, causes the electrical system or safety system of the treadmill 200 to stop or slow down movement of the belt 120.

Figure 4A:
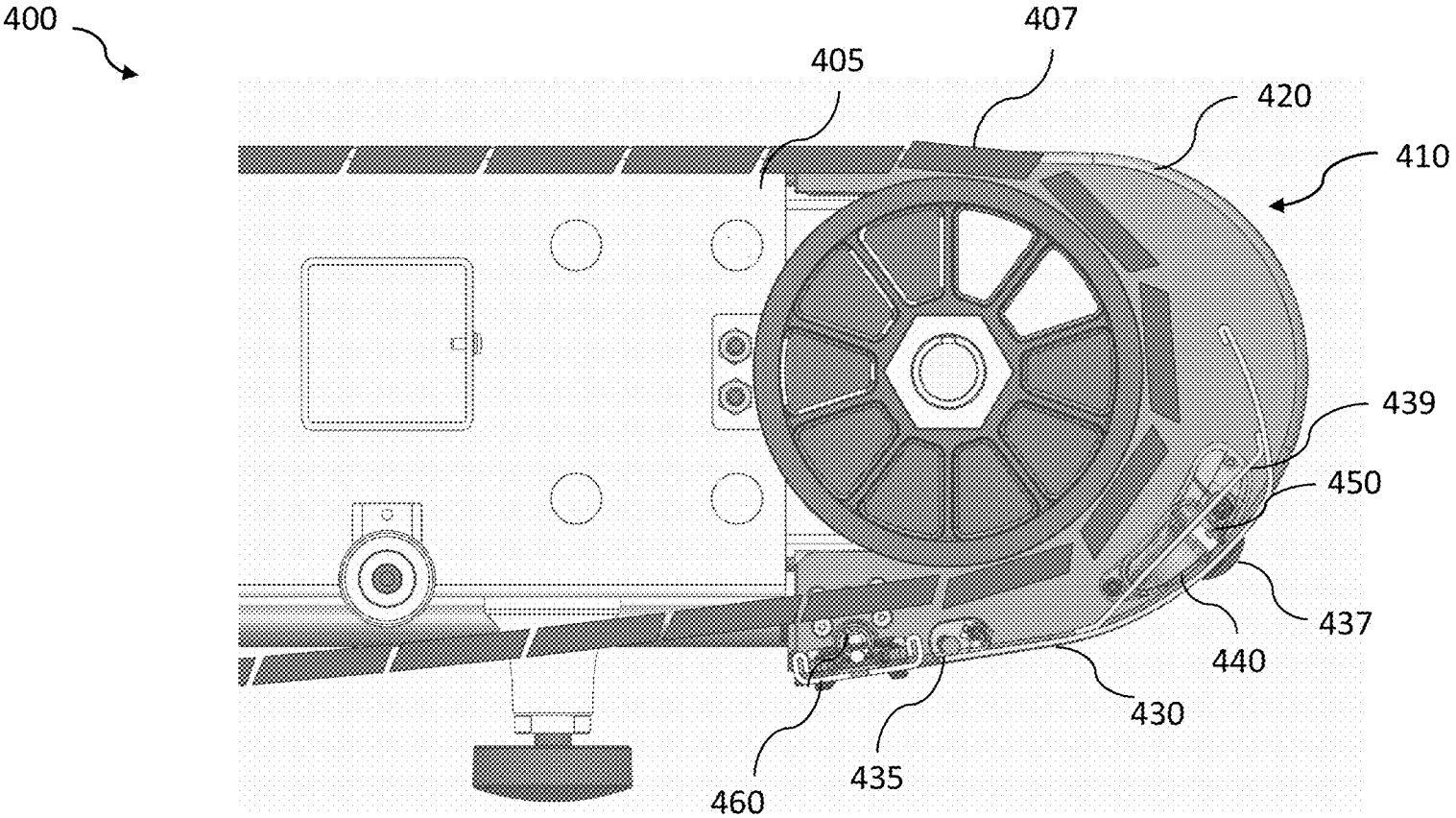
FIGS. 4A-4B are diagrams illustrating a guard assembly having a pivoting guard.
Figure 4B:
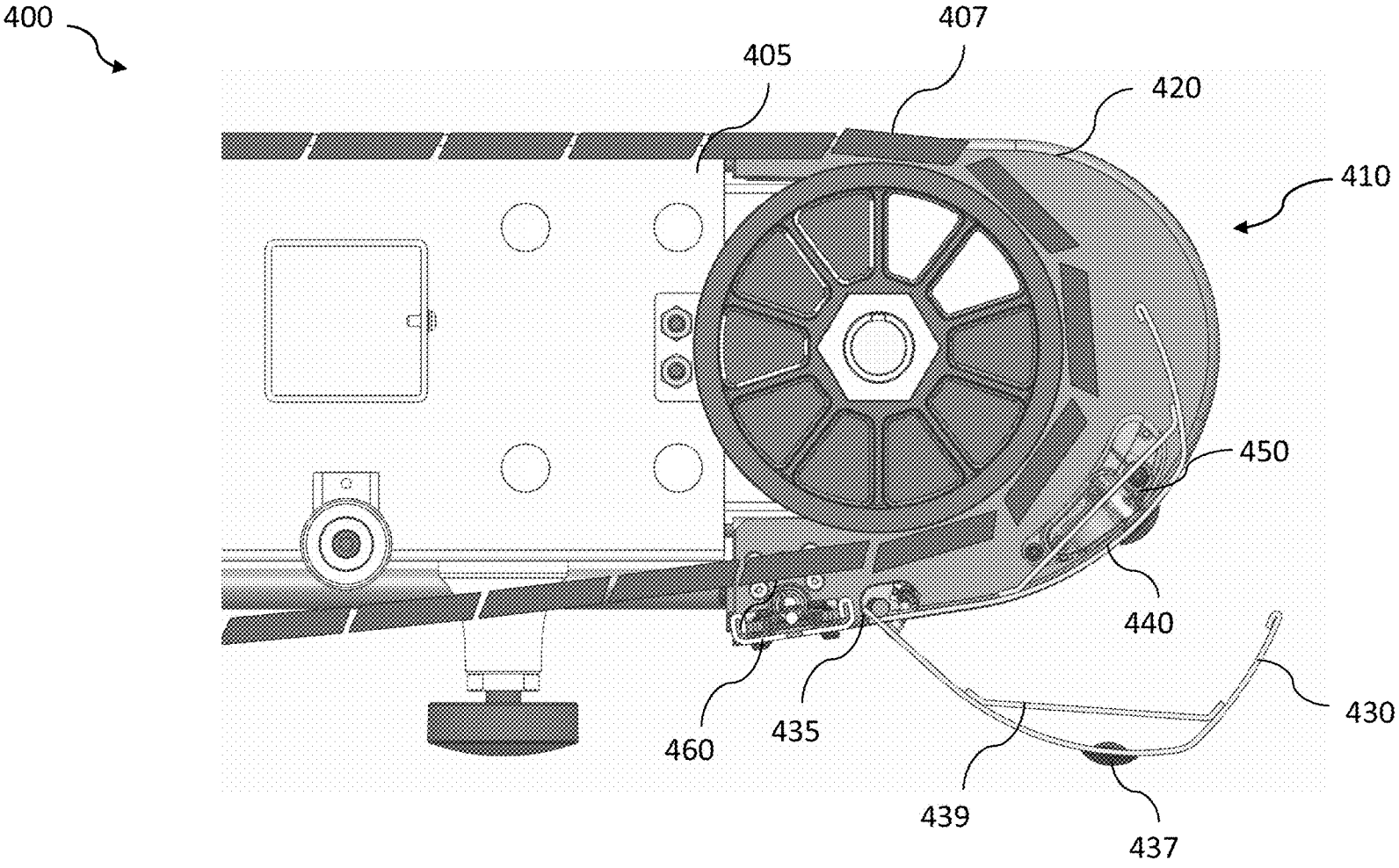

FIGS. 4A-4B are diagrams illustrating components of a treadmill 400 and guard assembly 410. As described herein, an end cap 420 can be fit (or retrofit) to a deck 405 of the treadmill 400. A slat-based belt 407 moves over and around a rear area of the deck 405 that is protected by the guard assembly 410. A pivoting guard 430, shown in a closed position (FIG. 4A) or an open position (FIG. 4B), is connected or coupled to the end cap 420 via a pivot component 435. The guard 430 may include a bumper 437, which protects the guard 430 when the guard 430 breaks away and contacts a floor or other surface supporting the treadmill 400, and a brace 439 or support element that provide additional mechanical support to the guard 430.

The end cap 420 includes a magnet 440 and an electromechanical switch 450. The guard 430, when in the closed position, is disposed proximate to the magnet 440 and the switch 450, such as by attaching, via the magnet 440, to the coupling mechanism. In some cases, the end cap 420 includes a lower fixed guard 460, such as a second guard that covers an under area of the deck of the treadmill 400.

As described herein, when the guard 430, which may be formed of metal (e.g., steel) or include metallic components, is in the closed position (see FIG. 4A), the magnet 440 (e.g., one of two magnets, each located on one side of the treadmill 400) secures the guard 430 to the end cap 410. However, when certain forces are applied to the guard 430, the guard detaches from the magnetic coupling (e.g., the forces overcome the magnetic forces) and the guard 430 moves to the open position (see FIG. 4B). Such movement, as described herein, may trigger (e.g., via the switch 450) the treadmill 400 to stop moving a belt or otherwise modify the current operations of the treadmill.

Figure 5:
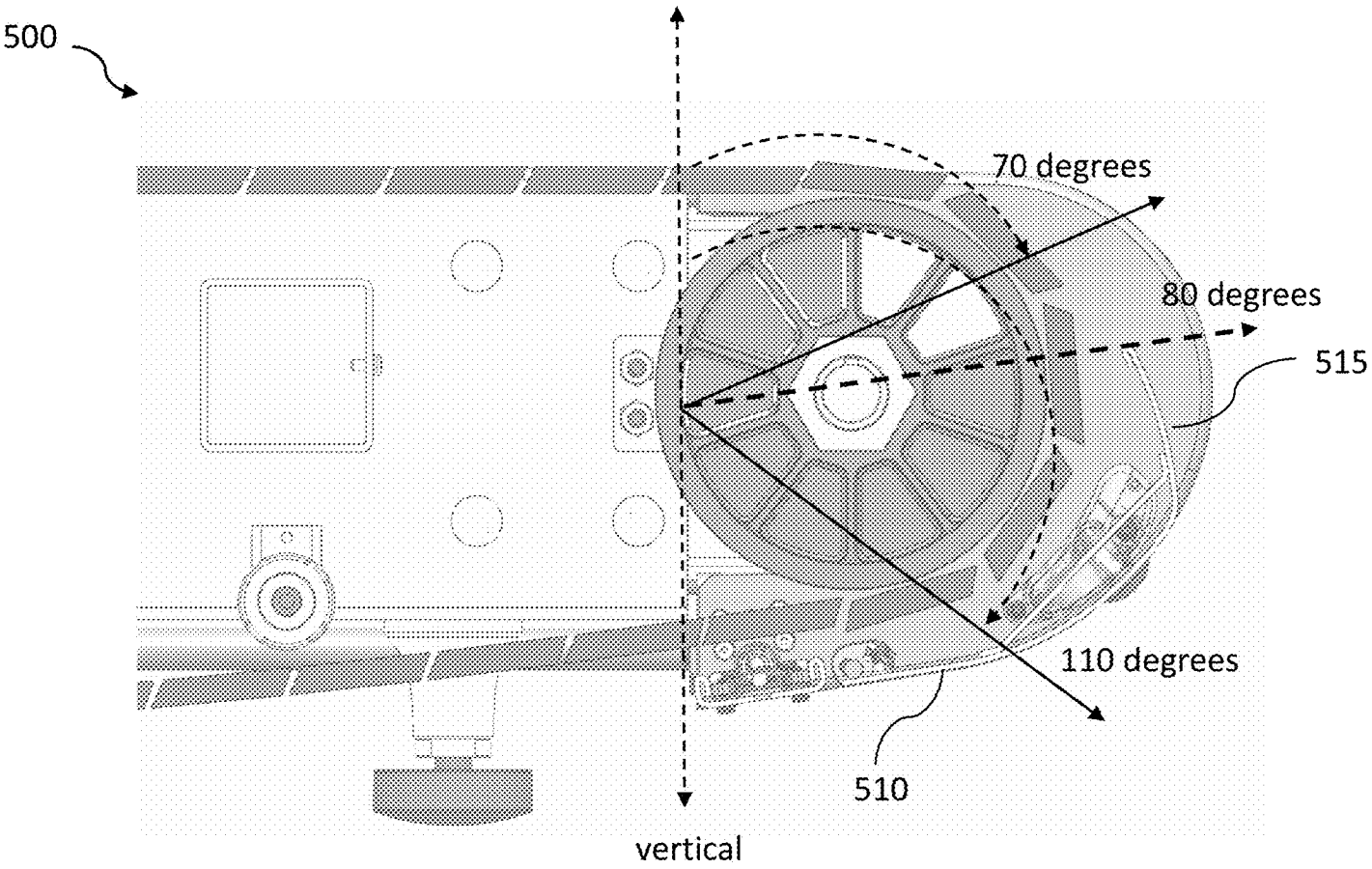
FIG. 5 is a diagram illustrating example positions for a pivoting guard of a guard assembly.

As depicted, the guard (e.g., the guard 430, 220, or 150) may extend to certain positions with respect to the rear area of a treadmill. FIG. 5 is a diagram 500 illustrating example positions for a pivoting guard of a guard assembly.

For example, a treadmill 500 may have a guard 510 where a top portion 515 is disposed or located at a position that is along a curved section of the deck, such as between 70 degrees to 110 degrees with respect to a vertical axis of the deck. As another example, the top portion 515 may be at a position that is between 2:00 to 5:00 clockwise along the curved section of the deck. As shown, the top portion 515 is positioned at approximately 80 degrees from the vertical, or about 2:20 in the clockwise direction.

Therefore, the guard 510, disposed in the various positions shown in FIG. 5, may prevent objects from moving under the moving surface without introducing additional issues associated with other configurations (e.g., configurations where the guard ends at or close to zero degrees vertical, or parallel to the running surface of a treadmill).

Thus, in various embodiments, the guard assembly includes a guard that extends partially around, from a bottom or lower area, of a deck, covering and/or protecting the lower area of the deck (e.g., the underside of the deck), and not an entire rear area of the deck. Via an end cap and associated coupling mechanism, the guard assembly facilitates the partial extension of the guard around the deck to various positions that facilitate covering a belt as it descends under the deck of the treadmill.

Because the guard assembly utilizes or includes a steel guard (or another stiff material or composition), the guard assembly may initiate a trigger to stop a treadmill based on certain conditions. For example, when the guard is not flexible, or not easily flexible, an object striking the guard (but not causing it to detach or break away) may not cause a false alert or trigger to the treadmill.

Further, utilizing the pivot components and stop components described herein, the guard assembly, via the end cap and coupling mechanism, can provide a functional guard assembly, regardless of mechanical tolerances introduced when manufacturing the guard assembly. For example, the guard is secured via the pivot and magnets at each end, and thus may slightly move or flex in place without triggering the switches or moving out of position.

In some embodiments, the end cap included a coupling mechanism (e.g., a magnet and switch) at each side of the rear area of a treadmill and sends a trigger or signal that the guard is in an open position when both switches (e.g., using series logic) are activated by the guard detaching from their associated magnets.

In some embodiments, the trigger logic operates to signal that the guard is open when both switches detect a small or similar movement away from each switch (e.g., ~1 mm), and thus maintain treadmill operations when one side of the guard is still fixed to a magnet. Using such logic, a treadmill may more effectively determine the guard is opening or breaking away (and not just flexing or moving in a closed position), causing operations to stop or modify, among other benefits.

For example, a safety mechanism for the treadmill may perform the following operations—receive, in series or parallel, signals from two or more switches integrated into an end cap of the treadmill, where the switches are activated when a guard detaches from magnets associated with the switches, and modify operations of the treadmill when the signals are received from the two switches (one on each side of the guard).

As described herein, the various embodiments of the guard assembly facilitate the retrofitting or modification of a treadmill with a pivoting guard. Thus, the guard assembly includes a guard and associated components (e.g., switches, magnets, stops) that are configured or usable to determine the position of the guard, and can act as a stand-alone assembly that can be fixed to a rear end of a treadmill (without relying on any components of a deck or frame of a treadmill to support the guard or determine its position).

Further, the guard assembly can be part of an end cap, where the end cap includes the guard assembly and can be retrofit to existing treadmills and/or can operate without using other components of the treadmill, such as components that are part of a frame of the treadmill.

Examples of Guard Assembly Configurations

As described herein, a guard assembly can include components or features that facilitate the guard to break away, or detach, in response to certain forces applied to the guard. The guard assembly, in some cases, can be retrofit to different treadmills, avoiding the use of components of the treadmill for support of a guard and/or detecting its movement or position, among other benefits.

Figure 6:
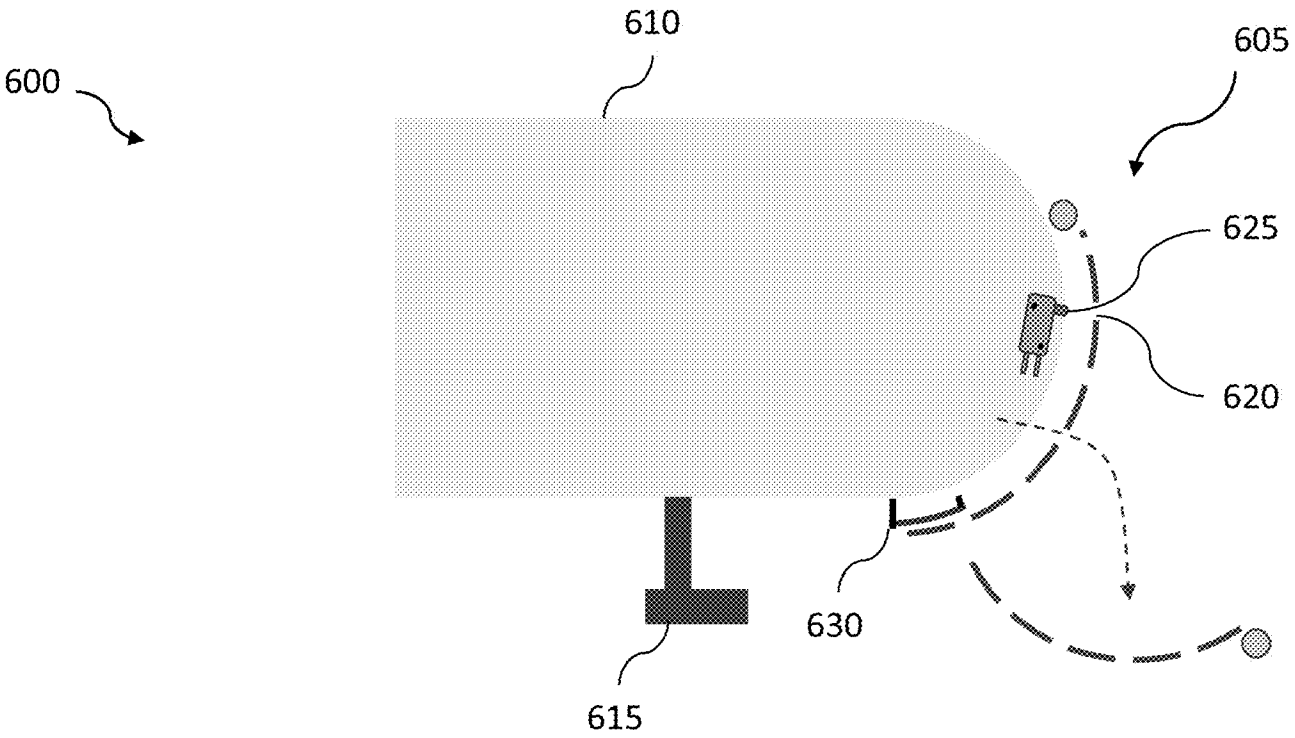
FIG. 6 is a diagram illustrating an example rear guard assembly.

FIG. 6 depicts a portion of a treadmill 600 having a guard assembly 605 attached (removably) to a deck or base 610 of the treadmill 600. The guard assembly 605 includes a rear guard 620 that is configured to break away from the deck 610 of the treadmill. The deck 610 can be supported by a foot 615 or other support structure.

The guard assembly 605 can include various features that prevent or limit objects from moving under the deck 610 of the treadmill 600, including the rear guard 620 and/or a secondary guard 630, which can include a gap or channel. Further details regarding the structure of the secondary guard 630 (and details regarding a suitable treadmill) can be found in U.S. patent application Ser. No. 17/939,877, filed on Sep. 7, 2022, entitled GUARD ASSEMBLY FOR EXERCISE MACHINE, which is incorporated by reference in its entirety.

The guard assembly 605 also includes a switch 625, which is triggered when the rear guard 620 breaks away or otherwise moves out of its secured position. The switch 625, when actuated, causes the treadmill 600 to modify operation of a moving surface of the deck 610, such as to slow the movement, stop the movement, decelerate the movement, and so on.

Figure 7:
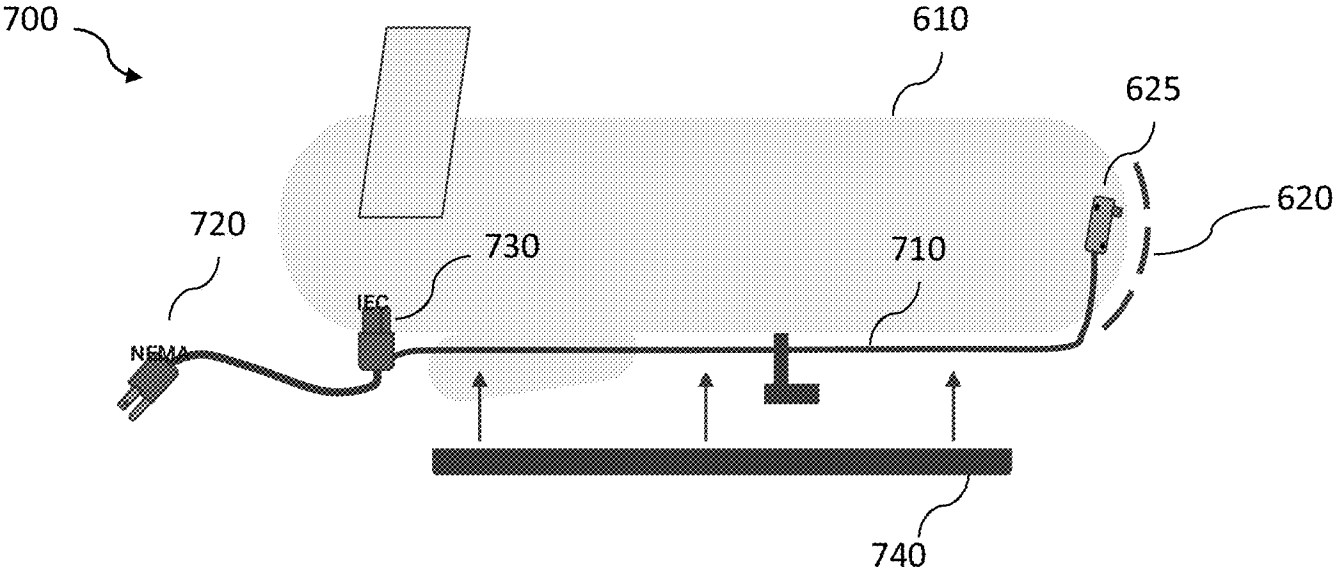
FIG. 7 is a diagram illustrating electrical components of a treadmill and rear guard assembly.

FIG. 7 is a diagram 700 that depicts additional details regarding components adapted to modify the operation of the treadmill 600. As shown, the switch 625, which can be a power interlock switch, is connected or coupled to a power cable 710 (e.g., a molded interrupt cable). The power cable 710 extends and connects to an IEC cord 720, which can have a C13 connector or other connector that connects to the treadmill housing. A NEMA cord 730 is coupled to the IEC 720, facilitating power from an AC receptable or other power source to the treadmill.

A cable management component 740 (e.g., adhesive backed or magnetically attached), can be utilized to house or maintain the cables with the deck of the treadmill 600. Such an arrangement avoids various connections to other components of the treadmill 600, such as a MCB, smartcard, or tablet. Thus, the treadmill 600 can house and include all components utilized to protect the rear of the treadmill 600 and modify its operations without any software/hardware updates or connections to an associated display, tablet, MCB, and so on, among other benefits. Further, the guard assembly 605 and associated connections can be utilized as a kit to retrofit or be installed onto treadmills lacking rear protection or guards, as described herein.

Figure 8:
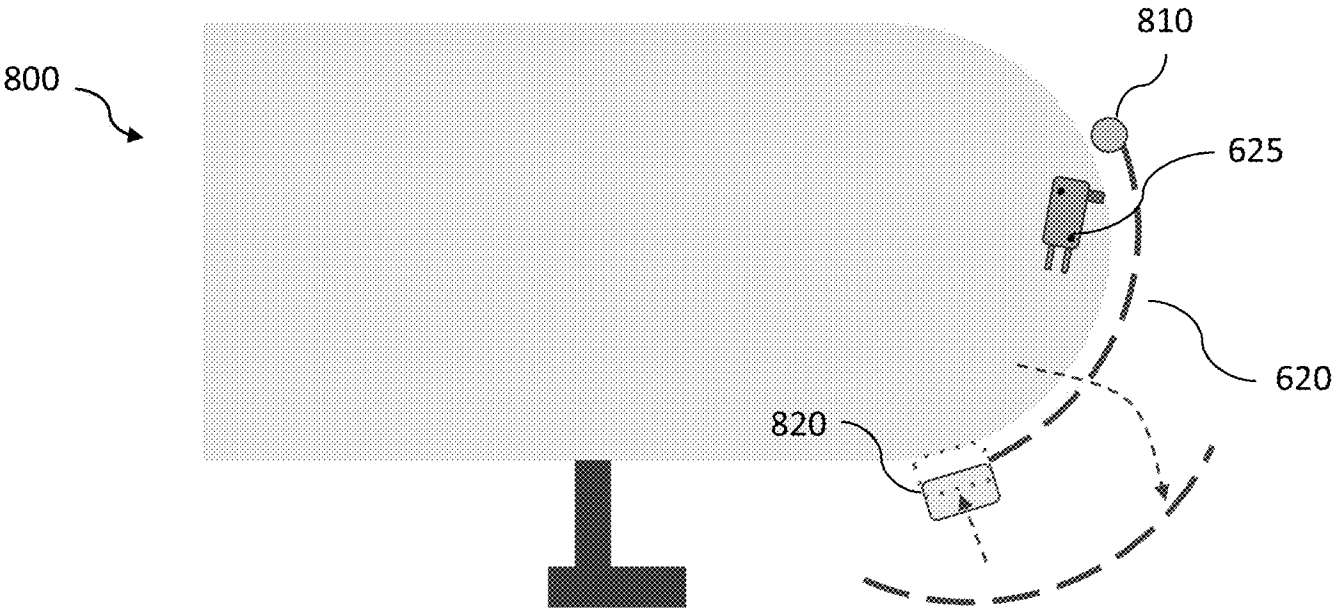
FIG. 8 is a diagram illustrating an example rear guard assembly having two rear guards.

FIG. 8 is a treadmill 800 that shows additional details of a guard assembly. The guard 620 includes a detent 810 that breaks away after a certain level of force is applied to the guard 620 (in various directions). The guard 820 can be placed at different locations on a rear of the treadmill 800, such as at 2:30 to 5:50 clockwise positions around the rear of the deck (or other positions, as described herein).

The deck also includes a secondary guard 820, which, as shown, can be placed at a 5:30 to 6:00 clockwise position. The guard 820 can be a friction block guard, having a small gap applied to slats of a moving surface when the guard 620 breaks away from the treadmill.

In some cases, gap sizes for the treadmill include a top gap for the guard 620 of 5-9 mm, a bottom gap for the guard 620 of 1.5 mm-5 mm (when in place), or 0 mm (when detached and in physical contact with slats of the deck. Thus, the guard assembly, as shown, can protect a treadmill with no gap adjustment operation at installation, can provide a single sided tether that prevents loss of the guard 620, can be heat and wear generated at contact interface, and so on.

The guard assembly can include other features as described herein, such as a pivot that connects a bottom portion of the guard to the deck and causes the guard to pivot in response to an applied force. In some cases, the pivot can also be removably attached and facilitate the guard breaking away from the rear of the treadmill upon a certain force being applied. The pivot can cause the guard to pivot downwards (in a clockwise manner), such as rotating about an axis parallel to rollers of the treadmill.

As described herein, in some embodiments, the treadmill can include an infrared beam (IR) trigger mechanism that is positioned under the deck of the treadmill (e.g., near the rear). The IR mechanism can detect an object impinging on an IR beam (or multiple IR beams), and modify current operations, such as slowing down, shutting off, or otherwise adjusting to a different state of operation.

For example, the trigger mechanism can include an IR beam component that emits an IR beam and is located on one side in an area underneath the deck of a treadmill, and an IR sensor that detects or receives the emitted IR beam and is located on an opposite side under the deck of the treadmill. When an object moves or is located under the deck, the object contacts or impinges the IR beam, causing the sensor to not receive the beam.

When the sensor does not receive the beam, the sensor can send a signal to the treadmill (e.g., to a safety control board of the treadmill) that indicates an object is likely under or moving under the deck of the treadmill. In response, the treadmill can slow down, shut off, alert a user, or otherwise adjust or modify to a different state of operation.

In some cases, multiple IR beams (and associated sensors) can be positioned under the deck of the treadmill. Each sensor (as part of a triggering mechanism) can be associated with a different signal, and the treadmill can perform different actions, based on which IR beam has been contacted by an object. For example, when an IR beam closest to the rear of the treadmill is blocked, the treadmill warns the user and slows the operation of the running surface. However, when a second IR beam, located inside of the rear IR beam, is blocked (e.g., perhaps indicative that an object is fully under the deck), the treadmill can warn the user and shut off operation.

In some cases, all areas under the treadmill can be monitored by IR beams. For example, an IR beam (and associated sensor) can be disposed or located under the sides of the deck, towards the front of the deck, and so on. Thus, the configuration of beam components and sensors can detect when objects enter the under area of the treadmill from the rear, from the sides, and/or from the front of the treadmill.

As described herein, in some embodiments, the treadmill can include other mechanical or sensor-based detection mechanisms or components. For example, the treadmill can include one or more inclinometers, accelerometers, gyroscopes, or other sensors that can detect a rear of a treadmill is moving upwards, tilting at an angle, or otherwise abnormally, and cause the treadmill to modify current operations, such as slowing down, shutting off, or otherwise adjusting to a different state of operation.

Thus, in various embodiments, a treadmill or other similar exercise machine can employ or implement various combinations of the mechanical assemblies and sensors described herein. For example, the guard assembly can be utilized to prevent objects from entering or moving under the deck, while a sensor can also be utilized to perform a shut-down operation (or other mitigation operation) when an object may enter or otherwise not be prevented by moving under the deck. Thus, a treadmill can incorporate various combinations of the technologies described herein.

EXAMPLE EMBODIMENTS OF THE DISCLOSED TECHNOLOGY

In some embodiments, a treadmill includes a deck, a belt that moves around the deck, and a guard assembly. The guard assembly includes a pivoting guard that is positioned at a rear area of the deck and an end cap that is coupled to an end of the deck and configured to releasably attach the pivoting guard to the end of the deck.

In some cases, the top portion of the pivoting guard is disposed at a position that is along a curved section of the deck. In some cases, a top portion of the pivoting guard is disposed at a position that is between 2:00 to 5:00 clockwise along the curved section of the deck.

In some cases, the end cap further comprises a switch that causes the treadmill to modify a current operation when the pivoting guard moves over a certain threshold distance.

In some cases, the end cap further comprises a magnet that releasable attaches the top portion of the pivoting guard to the end of the deck and a switch that causes the treadmill to modify a current operation when the pivoting guard partially detaches from the magnet of the end cap.

In some cases, the guard assembly includes a pivot that attaches a lower portion of the pivoting guard to the end cap.

In some cases, the belt that moves around the deck is a slat-based belt.

In some cases, the top portion of the pivoting guard includes a hook shape that releasably attaches to the end cap.

In some embodiments, a guard assembly includes a guard that is positioned at a rear area of a deck of a treadmill, a pivot component that fixes a lower portion of the guard to a lower section of the rear area of the deck, and an end cap configured to be coupled to an end of the deck of the treadmill, wherein the end cap includes a magnet that releasably attaches a center portion of the guard to the end cap.

In some cases, the end cap further includes a switch positioned proximate to the magnet and configured to send a signal to the treadmill that indicates the guard has detached from the magnet.

In some cases, the top portion of the guard is disposed at a position that is along a curved section of the deck of the treadmill.

In some cases, the top portion of the guard is disposed at a position that is between 2:00 to 5:00 clockwise along the curved section of the deck. In some cases, the top portion of the guard is disposed at a position that is 80 degrees from vertical along the curved section of the deck. In some cases, the top portion of the guard includes a hook shape that releasably attaches to an inner section of the end cap. In some cases, the top portion of the guard includes a bumper.

In some cases, the end cap is configured to be fixed to the rear area of the deck of the treadmill.

In some cases, the guard is formed of metal and includes one or more structural ribs or braces.

In some embodiments, a treadmill includes a deck, a slat-based belt that moves around the deck, and an end cap fixed to a rear end of the deck. The end cap includes a pivot disposed at a lower portion of the end cap, and a guard that is fixed to the pivot and releasably attached to a top portion of the end cap, where the guard has a curved shape and extends from the lower portion of the end cap to a location of the end cap that is between 70 and 100 degrees from vertical.

In some cases, the guard includes a metal body and a hook shaped end portion.

In some cases, the end cap includes a coupling mechanism at each side of the treadmill, the coupling mechanism including a magnet that releasably attaches a body or center portion of the guard to the end cap, and a switch positioned proximate to the magnet and configured to send a signal to the treadmill that indicates the guard has detached from the magnet.

In some cases, the end cap included a coupling mechanism at each side of the end cap, where a switch in each coupling mechanism sends a signal to the treadmill to indicate guard has detached from the magnet.

In some cases, the treadmill modifies operations based on signals being received from both switches of the end cap, and not from a single switch of the end cap.

CONCLUSION

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the terms "connected," "coupled," or any variant thereof, means any connection or coupling, either direct or indirect, between two or more elements; the coupling of connection between the elements can be physical, logical, or a combination thereof. Additionally, the words "herein," "above," "below," and words of similar import, when used in this application, shall refer to this application as a whole and not to any particular portions of this application. Where the context permits, words in the above Detailed Description using the singular or plural number may also include the plural or singular number respectively. The word "or", in reference to a list of two or more items, covers all of the following interpretations of the word: any of the items in the list, all of the items in the list, and any combination of the items in the list.

The above detailed description of embodiments of the disclosure is not intended to be exhaustive or to limit the teachings to the precise form disclosed above. While specific embodiments of, and examples for, the disclosure are described above for illustrative purposes, various equivalent modifications are possible within the scope of the disclosure, as those skilled in the relevant art will recognize.

The teachings of the disclosure provided herein can be applied to other systems, not necessarily the system described above. The elements and acts of the various embodiments described above can be combined to provide further embodiments.

Any patents and applications and other references noted above, including any that may be listed in accompanying filing papers, are incorporated herein by reference. Aspects of the disclosure can be modified, if necessary, to employ the systems, functions, and concepts of the various references described above to provide yet further embodiments of the disclosure.

These and other changes can be made to the disclosure in light of the above Detailed Description. While the above description describes certain embodiments of the disclosure, and describes the best mode contemplated, no matter how detailed the above appears in text, the teachings can be practiced in many ways. Details of the technology may vary considerably in its implementation details, while still being encompassed by the subject matter disclosed herein. As noted above, particular terminology used when describing certain features or aspects of the disclosure should not be taken to imply that the terminology is being redefined herein to be restricted to any specific characteristics, features, or aspects of the disclosure with which that terminology is associated. In general, the terms used in the following claims should not be construed to limit the disclosure to the specific embodiments disclosed in the specification, unless the above Detailed Description section explicitly defines such terms. Accordingly, the actual scope of the disclosure encompasses not only the disclosed embodiments, but also all equivalent ways of practicing or implementing the disclosure under the claims.

From the foregoing, it will be appreciated that specific embodiments have been described herein for purposes of illustration, but that various modifications may be made without deviating from the spirit and scope of the embodiments. Accordingly, the embodiments are not limited except as by the appended claims.

What is claimed is:

1. A treadmill, comprising:
a deck;
a slat-based belt that moves around the deck; and
an end cap fixed to a rear end of the deck, wherein the end cap includes:
a pivot disposed at a lower portion of the end cap;
a guard that is fixed to the pivot and releasably attached to a top portion of the end cap at a location of the end cap that is between 80 and 100 degrees from a vertical axis of the treadmill.

2. The treadmill of claim 1, wherein the guard includes:
a metal body; and
a hook shaped end portion.

3. The treadmill of claim 1, wherein the end cap includes a magnet that releasably attaches a center portion of the guard to the end cap.

4. The treadmill of claim 1, wherein the end cap includes a switch configured to send a signal to the treadmill that indicates the guard has detached from the end cap.

5. The treadmill of claim 1, wherein a top portion of the pivoting guard is disposed at a position that is 80 degrees from the vertical axis of the treadmill.

6. A treadmill, comprising:
a deck;
a belt that moves around the deck;
an end cap that is coupled to a rear end of the deck; and
a pivoting guard that releasably attaches to the rear end of the deck at a position of the end cap that is 80 degrees from a vertical axis of the treadmill.

7. The treadmill of claim 6, wherein the end cap further comprises:
a switch that causes the treadmill to modify a current operation when the pivoting guard moves over a certain threshold distance away from the end cap.

8. The treadmill of claim 6, wherein the end cap further comprises:
a magnet that releasable attaches a body portion of the pivoting guard to the rear end of the deck; and
a switch that causes the treadmill to modify a current operation when the pivoting guard partially detaches from the magnet of the end cap.

9. The treadmill of claim 6, further comprising: a pivot that attaches a lower portion of the pivoting guard to the end cap.

10. The treadmill of claim 6, wherein the belt that moves around the deck is a slat-based belt.

11. The treadmill of claim 6, wherein a top portion of the pivoting guard includes a hook shape that releasably attaches to the end cap.

12. A guard assembly for a treadmill, comprising:
a guard that is configured to be positioned at a rear area of a deck of the treadmill; and
a pivot component that fixes a lower portion of the guard to a lower section of the rear area of the deck,
wherein a top portion of the guard is disposed at a position that is 80 degrees from the vertical axis along a curved section of the deck.

13. The guard assembly of claim 12, further comprising:
a magnet disposed at the rear area of the deck; and
a switch positioned proximate to the magnet and configured to send a signal to the treadmill that indicates the guard has detached from the magnet.

14. The guard assembly of claim 12, wherein the top portion of the guard includes a hook shape that releasably attaches to an inner section of the rear area of the deck.

15. The guard assembly of claim 12, wherein a body portion of the guard is formed of metal.

16. The guard assembly of claim 12, wherein the guard is formed of metal.

17. The guard assembly of claim 12, wherein the guard includes one or more structural ribs.

18. The guard assembly of claim 12, wherein the guard includes one or more braces.

* * * * *